United States Patent [19]

Hobbs et al.

[11] 4,405,392

[45] Sep. 20, 1983

[54] METHOD OF MAKING PRIMING COMPOSITION

[75] Inventors: John F. Hobbs, Sutton Coldfield; Gordon R. Sutcliffe, Hartlebury Nr. Kidderminster, both of England

[73] Assignee: Imperial Metal Industries (Kynoch) Limited, Birmingham, England

[21] Appl. No.: 722,070

[22] Filed: Sep. 3, 1976

[30] Foreign Application Priority Data

Sep. 11, 1975 [GB] United Kingdom ..... 37385/75

[51] Int. Cl.[3] ..... D03D 23/00

[52] U.S. Cl. ..... 149/109.6; 149/24; 149/35; 149/88

[58] Field of Search ..... 149/24, 35, 109.6, 88

[56] References Cited

U.S. PATENT DOCUMENTS 3,066,161 11/1962 Komarmy et al. ..... 149/24 X 3,894,068 7/1975 Taylor ..... 149/24 X

*Primary Examiner*—Stephen J. Lechert, Jr.

*Attorney, Agent, or Firm*—Cushman, Darby & Cushman

[57] ABSTRACT

A method of producing a priming composition comprising reacting components to produce a primary explosive and a by-product which remains in the composition.

5 Claims, 1 Drawing Figure

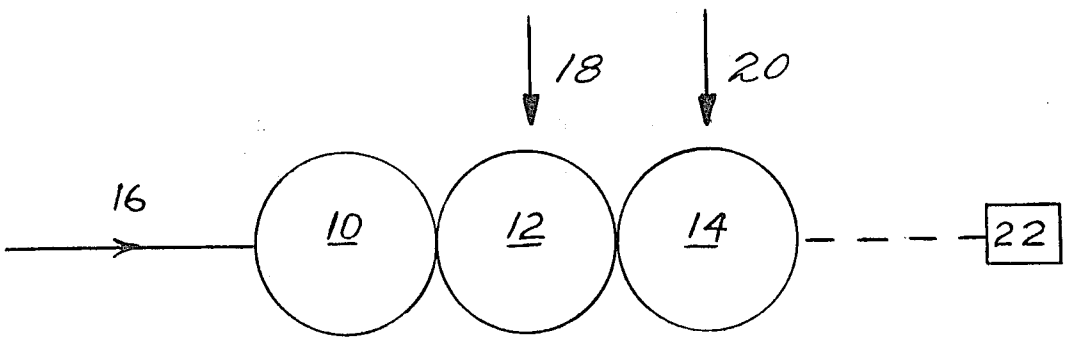
16
10
18
12
20
14
22

METHOD OF MAKING PRIMING COMPOSITION

BACKGROUND OF THE INVENTION

The present invention relates to production of explosives.

In current practice, primary explosive for priming of explosive devices (e.g. ammunition cartridges and detonators) is prepared away from the priming zone in a large batch or at the maximum possible continuous rate. At the priming stage, explosive is drawn from store and mixed with other ingredients of a composition in a substantial batch which is then distributed between elements of the devices (e.g. cap shells, cartridges cases or detonator cases). This sequence involves bulk storage, transport to a mixing station, the mixing operation itself, transport of the mixture to the priming zone, and distribution between said elements. Since primary explosives are inherently dangerous to manufacture and handle, each stage of the sequence is hazardous and needs special precautions, particularly where explosive is present in bulk.

In a method of producing explosive for priming explosive devices, the present invention employs any one of the following three features alone, or any combination of them:

1—said explosive is produced in a relatively small quantity, preferably appropriate to an individual utilisation demand, 2—said explosive is produced at a relatively low output rate, preferably not substantially greater than the rate at which it is used in priming, 3—production of said explosive is substantially continuous, or simultaneous, with its further utilisation.

The explosive may be produced in a batch sufficient for a plurality of individual utilisation demands, but small relative to conventional batches. In order to satisfy total output demand, there may be a series of such batches, which can be separated by a distance and/or in a manner facilitating isolation of an explosion in any one batch. The batches can be produced in regular succession, e.g. at predetermined time intervals, thereby facilitating adequate spacing and subsequent handling.

The maximum permissible size of each batch will depend upon the type of explosive and the conditions under which it has to be produced. The sensitivity, explosive energy, required production conditions and divisibility for use of the explosive will all affect the batch size. The total output demand per unit time will also influence the batch size, as will the precautions taken to isolate individual batches. Conventional priming composition for rimfire cartridges uses lead styphnate as primary explosive: a batch of styphnate sufficient for, say, 20 priming charges for rimfire cartridges could be made and divided between the rimfire cases in a continuous operation: corresponding arrangements could be made for priming shotgun cap shells and detonator cases. Larger batches will obviously involve extra precautions, but batches as large as several ounces could be produced at intervals of about one minute.

Batches may also be combined for an individual utilisation demand, or for total output demand if not immediately used. However, neither combination nor division of batches is preferred, since both incur additional hazards. The preferred arrangement is one in which a batch is matched to an individual utilisation demand, for example each batch in a series is just sufficient for a priming charge for one rimfire cartridge, shotgun cap or detonator. This permits simultaneous production and utilisation where the explosive is produced in situ in a utilising device.

In this specification, the terms "utilising device" and "production in situ" have the following meanings:

Utilising device—refers to a combination of a least two elements of an explosive device, at least one of which elements is a body of said explosive. The other element may be a mere container or carrier for the explosive, such as a rimfire cartridge case, a detonator case or a cap shell. The utilising device may be a finished explosive device, but it is more likely to be only partly finished; for example (a) further elements may have to be added to it to make up the explosive device, such as propellant and a bullet for a rimfire cartridge, or an electric match or a fuse for a detonator; (b) the elements may have to be reshaped, or relocated relative to each other as when priming composition in a rimfire cartridge case is forced into the rim of the case by a conventional spinning punch after explosive has formed in the head of the case.

Production in situ—means that the explosive is produced in relation to at least one other element so as to provide said combination. When the other element is a container, the explosive will normally be produced within it. If the other element were a carrier, the explosive could be produced as a body around a portion of the carrier. As indicated above, producing in situ does not imply that the combination is immediately ready for final use.

The explosive may be produced in a continuous or semi-continuous stream but at a rate which is low relative to conventional continuous or semi-continuous processes.

Production of explosive in the form of a continuous stream or series of batches is facilitated if the production process is continuous, or simultaneous, with the utilisation stage, for example incorporation in an explosive device. Continuity does not imply immediate use; in practice, there will inevitably be a degree of "live storage" where production is not effected in situ. However, there will be a continuous flow path between the production and utilisation stages, so that off-line storage of dangerous substances is reduced or eliminated. To this end, the production rate and utilisation rate are preferably substantially matched, at least on average over a period.

In any process according to the invention, the components used to produce the explosive are preferably comparatively insensitive, thereby mitigating storage problems.

A production process in accordance with the invention is preferably automated. The components required for production of the explosive may be automatically metered into batches under controlled thermal conditions, even where small quantities are required. Preferably, too, an automated production process is integrated with an automated utilisation stage producing at least a partially finished explosive device; for example, in the case of rimfire cartridge priming, primary explosive production can be continuous with an automatic line for receiving primed cases, loading propellant, and inserting the bullet.

SUMMARY OF THE INVENTION

According to the preferred method in accordance with the present invention, comparatively insensitive, preferably non-explosive, components are brought together to produce a primary explosive in a relatively small quantity, for example suitable for an individual utilisation demand such as a body of initiating composition for an explosive device. Preferably the small quantity is one of a series of such quantities.

Where the explosive is to be used in a device, production of the explosive is preferably effected wholly in situ in the device. However, it is within the broad scope of the invention to complete production of the explosive away from the device, the product thereafter being supplied to the device, or to bring the components together away from the device and to complete production of the explosive in situ.

The explosive may be produced in a mixture, for example for use as an initiating composition when primary explosive has formed therein. Thus, primary explosive may be produced in a mixture which comprises a fuel, an oxidiser and a frictionator, for example as disclosed in U.S. Pat. No. 2,239,547 to Brun.

It is within the broad scope of the invention to mix further ingredients with the formed explosive, but this is not preferred because it involves additional processing steps, which may be hazardous and therefore may necessitate additional precautions.

Production of the explosives may be effected in a liquid medium, preferably water. A relatively soluble component may therefore be added in solution to a relatively insoluble component and the relatively insoluble component may then be in powder form. The resultant product may be forced into a desired position in utilising device while wet, pre-drying being effected if required to produce the product in mouldable form. In one example, the product is spun in a rimfire case by means of a conventional spinning punch to force the product into the rim of the case; in another, the product is compressed in a cap shell, and complete drying may then precede compression. The product should be compatible with the container in which it is to be used, for example the detonator case, rimfire case or cap shell. Further, where production is to be effected partially or wholly in situ, the solution should be compatible with the container.

The process may be used to produce any explosive in which the desired reaction will occur with relatively small quantities of reacting components. Preferably all reaction products can either be used in the explosive product, or removed while enabling continuous utilisation. An example given below will show application of the invention to production of lead styphnate. Further examples are given in a U.S. patent application in the names George Byron Carter and Alan Cross claiming priority from British Patent Application No. 37386/75 filed Sept. 11, 1975. Since relatively small quantities of dangerous substances are involved, the invention may enable the use, as a primary explosive in a priming composition, of materials normally considered too dangerous for that purpose.

The invention also provides apparatus for producing explosive for use in priming explosive devices comprising means for bringing together materials, which together will form said explosive, at a low rate and/or in a succession of small quantities preferably appropriate to indiviual utilisation demands, and/or on a flow path continuous with means for supplying partially or completely formed explosive to a succession of other elements of utilising devices.

Where it is desired to produce explosive in a succession of small quantities, the apparatus may comprise a plurality of dispensing means, each adapted to dispense predetermined doses of material to respective receivers therefor so that each receiver will receive a dose from each dispensing means of said plurality.

The materials dispensed may comprise components of an explosive and a medium in which said components can interact to produce the explosive. The medium will probably be a liquid ionising medium, preferably water. Respective dispensing means may dispose respective components, or one dispensing means may dispense all components and another dispense said medium or they may dispense respective mixtures.

The receivers are preferably containers for the explosive each adapted to provide part of an eventual utilising device. The containers will probably be made of metal, for example metal cap shells, cartridge cases or detonator cases. However, this is not essential. For example, in UK Patent Specification No. 1 212 615 there is described a method of priming caseless propellants for ammunition; in that method a priming composition made up as a slurry is dispensed into a depression in one end of a body of propellant. Such a process could be adapted to the present invention by supplying materials as referred to above instead of a pre-formed priming slurry.

Each dispensing means may comprise a plurality of individual dispensers so that a corresponding plurality of receivers can be processed simultaneously by that dispensinng means. Means may be provided to mix dispensed materials. The receivers may then be passed to a drying means, for example an oven. There may be automatically operable transporting means for carrying receivers to and from dispensing means, mixing means and drying means. The transporting means is preferably of the type arranged to produce continuous substantially uniform motion of receivers through the transport system, avoiding acceleration and deceleration while the receivers remain on the transport system. A suitable form of transport system comprises pocketed wheels, for example of the general type described in U.S. Pat. No. 2,358,315.

BRIEF DESCRIPTION OF THE DRAWING

By way of example, one embodiment of apparatus suitable for use in priming of rimfire cartridge cases will now be described with reference to the accompanying diagrammatic drawing.

DESCRIPTION OF THE PREFERRED EMBODIMENT

The illustrated apparatus comprises a transport system made up of a plurality of pocketed wheel modules three of which are shown at 10, 12 and 14 respectively. The use of this type of transport system enables different process times to be accommodated on different modules while permitting uniform motion of transported articles through the transport system as a whole, i.e. without acceleration and deceleration.

Module 10 accepts rimfire cartridge cases from a suitable feed indicated by arrow 16 and passes them at a predetermined rate to module 12. Here, each case receives a predetermined dose of a first component required for a chemical reaction to produce a primary explosive, as indicated by arrow 18. The cases are then passed in succession to module 14, where they receive a predetermined dose of a second component required to produce the explosive, as indicated by arrow 20. At least one of these modules will dispense a liquid, preferably comprising water. One or both of the modules may dispense ingredients of a primary composition other than the primary explosive which is to be produced in the case.

Further processing depends on the chemistry of the reaction involved. If required, mixing means may be used to mix the ingredients in the case. There may be means for removing excess liquid in the case when it is no longer required for the reaction. In any event, the cases are finally passed to an oven, diagrammatically indicated at 22, where the composition in the cases is dried out. The dried primed cases may then be passed to a line, preferably automated, for propellant charging and insertion of the bullet, if the cartridge is not a blank.

The following is an example of a process in accordance with the invention used to prime rimfire cartridge cases by reaction of components in situ in the cartridge case.

The primary explosive in the initiating composition was lead styphnate, which was formed by a double decomposition reaction of sodium styphnate and lead nitrate. The proportions of components mixed and reacted to form the priming composition were as follows:

| (parts by weight) | | |
|---|---|---|
| Sodium styphnate | 27 parts | DRY |
| Lead hypophosphite | 7 parts | DRY |
| Grit | 25 parts | DRY |
| Lead nitrate | 31 parts | WET |
| Tetrazene | 3 parts | WET |
| Gum Arabic | — | WET |
| Lissapol | — | WET |

The first three ingredients are relatively insoluble in water when compared with lead nitrate, and they were provided in powder form in the rimfire case, in a predetermined dose. The dose required depends upon the quantity of initiating composition required to ensure ignition of the propellant. In a cartridge designed to contain about 80 mg of nitrocellulose base powder as propellant, the quantities of the reacting components were such as to produce about 20 mg of initiating composition. This can be adjusted as required to give designed ballistic characteristics for the combination.

Lead nitrate is soluble in water, and was added to the dry ingredients in aqueous solution. The tetrazene was dispersed in the lead nitrate solution, this being a dangerous material to handle dry. The double decomposition reaction between the lead nitrate and the sodium styphnate then occurred in the cartridge case, giving lead styphnate and sodium nitrate in the resultant mixture. The product was dried out after the reaction, and then approximately 10% by volume of water was added to the dried mixture to render it mouldable. The rimfire case containing the mouldable composition was then passed to a conventional spinning punch to force the composition into the rim of the case in the conventional manner. The moulded composition was then passed through a conventional drying arrangement and the primed case was subsequently handled in the conventional fashion.

The double decomposition reaction described above was carried out at room temperature. Increased temperature may lead to larger crystal sizes for the lead styphnate and this may affect sensitivity of the composition. Increase of temperature runs the risk of decomposition of the tetrazene, this being a particular problem above about 70° C. However, the highest possible temperature, subject to other restraints, is advantageous in facilitating crystallisation of the lead styphnate from the gel which forms in the early stages of the double decomposition reaction.

No steps were taken to control the pH of the mixture in the cartridge case. This would be slightly acid because of the presence of the lead nitrate solution, and slight acidity is necessary for crystallisation of the lead styphnate. A pH in the range 3 to 6 is suitable.

The quantity of water used was just sufficient to take the lead nitrate into solution. This gives a paste consistency to the mixture after addition of the solution. It is desirable to minimise the quantity of water used since it has to be driven off after the lead styphnate has formed.

The invention is not limited to formation of one compound only in the mixture. A proportion of the double salt lead nitrate hypophosphite may also form simultaneously with the styphnate, in the manner described in the co-pending patent application referred to above. This may improve the sensitivity of the composition. Also, it may be desirable to produce the tetrazene simultaneously with the lead styphnate, since difficulties may be encountered in maintaining an adequate dispersion of tetrazene in lead nitrate solution. However, there are severe temperature limitations associated with the prouction of tetrazene, and this may cause difficulty in the production of the lead styphnate.

The invention is not limited to priming of rimfire cartridges, and different mixtures will be required for different uses. For example, in priming of caps for shotgun cartridges, the primary explosive may again be lead styphnate, but the grit can be omitted and antimony sulphide, in dry powder form, can be substituted for it. In priming of detonators, the primary explosive may be lead azide, which can be produced by double decomposition of lead nitrate and sodium azide.

The starting materials referred to above are insensitive when compared with the lead styphnate which provides the primary explosive. However, dry sodium styphnate can be caused to explode if ignited by a black powder fuse, and it may therefore be necessary to store this material in a wet form and feed it to the cartridge case in the form of a paste. Since only small quantities of materials are involved in each individual reaction, it may be possible to use a starting material having quite substantial sensitivity, although less than the eventual primary explosive. For example, in U.S. Pat. No. 2,239,547 to Brun, there is described a method of making normal lead styphnate by admixture of reacting quantities of basic lead styphnate, styphnic acid and other priming composition ingredients, the normal lead styphnate being formed in the mixture. The process described in that specification therefore involves the conversion of one explosive, basic lead styphnate, into a more sensitive explosive, normal lead styphnate, in a mixture of other ingredients. Such a process could be adapted to the present invention.

It will be appreciated, however, that it is preferable to use non-explosive components, or at least components having low sensitivity such as sodium styphnate. Conventional processes of producing normal lead styphnate do use insensitive components, but they normally involve the removal of one product of the double decomposition reaction to enable the use of the lead styphnate in a priming composition. For example, where the lead styphnate is produced by reaction of lead nitrate and magnesium styphnate, the resulting magnesium nitrate is normally washed out of the product, leaving the lead styphnate for use in the priming composition.

The present invention provides a method of producing a priming composition comprising reacting components to produce a primary explosive and a by-product which remains in the composition. The by-product may be an oxidiser. The primary explosive may be a heavy metal styphnate.

The oxidiser preferably forms a substantially anhydrous crystal, and preferably has a low degree of hygroscopicity. It is preferably a nitrate.

The styphnate feedstock should be as soluble as possible subject to satisfying the above requirements. Sodium styphnate has an acceptable solubility, and sodium nitrate performs satisfactorily as an oxidiser in a mixture containing lead styphnate, replacing the conventional barium nitrate. Potassium and ammonium styphnate are also satisfactory on the basis of solubility, but potassium and ammonium nitrate have not performed satisfactorily as oxidisers. Magnesium styphnate is the most soluble, but magnesium nitrate includes a substantial quantity of water of crystallisation, which is difficult to remove.

The heavy metal is preferably lead.

The reaction may be a double decomposition reaction. The temperature at which it occurs may be made as high as possible subject to thermal decomposition of the components. High temperatures facilitate crystallisation of lead styphnate from the gel produced in the initial stage of the reaction. Temperatures up to 80° C. are possible, but higher temperatures in this range may result in large crystal sizes for the styphnate, which may be disadvantageous in some circumstances.

It is not necessary for a double decomposition reaction to provide all of the oxidiser required in a composition. For example, a conventional oxidiser such as barium nitrate may be added to the composition after formation of the heavy metal styphnate therein. Addition of barium nitrate at an early stage in the reaction may result in the formation of barium styphnate which is an insensitive explosive relative to lead styphnate.

A slightly acid solution will be required in order to produce the heavy metal styphnate; for example a pH in the region 3 to 6 will normally be found suitable, although a slightly lower pH value may also be found satisfactory.

The explosive and by-product can be produced in a mixture of other ingredients, which may include each or either of a frictionator and a fuel. Alternatively, these ingredients may be added to the composition after the heavy metal styphnate and oxidiser have been produced.

Where the heavy metal is lead, the process conditions are preferably controlled so as to result in formation of normal lead styphnate, but a proportion of basic lead styphnate may be found acceptable depending upon the required circumstances of use. The yield of lead styphnate can be improved by thorough mixing of the components, so as to minimise the proportion of unreacted feedstock remaining in the composition. Where the process is carried out on a small scale, as in the example cited above of priming of rimfire cases by reacting components in situ, mixing can be effected by vibration of the reacting components. The yield of normal lead styphnate can be improved by control of the pH, and it may be necessary to add free acid to ensure the required acidity in the reacting mixture.

The first stage of the double decomposition reaction to form lead styphnate is the formation of a gel from which the styphnate crystallises. The time required for crystallisation from the gel stage depends upon the temperature and the concentration of the mixture, the time being longer for lower temperatures and higher concentrations. Where the composition is being produced in situ, maximum concentration is desirable to avoid having to drive off the solvent, usually water. Thus maximum permissible temperature is also desirable, but this will be limited by the tendency towards thermal decomposition of reacting components and resulting products, and possibly also by the effects of increasing temperature upon crystal size of the styphnate.

The invention also extends to a device incorporating an explosive produced by a method according to the invention and to explosive so produced.

We claim:

1. A method of producing in situ a priming composition which comprises a primary explosive selected from the group consisting of styphnates and azides together with at least one other ingredient, said method comprising the step of causing a reaction between components which will react to produce said primary explosive, said reaction occurring in situ with the components in admixture with the remainder of the composition, the reaction also producing a by-product which remains in the composition.

2. A method as in claim 1 wherein said by-product will function as an oxidizer in the composition.

3. A method as in claim 2 wherein said by-product is a nitrate.

4. A method as in claim 3 wherein said primary explosive is lead styphnate and wherein said components which react to produce the primary explosive comprise lead nitrate and an alkali metal styphnate.

5. A method as in claim 4 wherein said alkali metal styphnate is sodium styphnate.

* * * * *